US005528918A

United States Patent [19]

Kirii

[11] Patent Number: 5,528,918

[45] Date of Patent: Jun. 25, 1996

[54] METHOD AND APPARATUS FOR ADJUSTING PRESSURE OF CUSHIONING PNEUMATIC CYLINDER ON PRESS WHEN CUSHION PLATEN IS AT SETUP POSITION

[75] Inventor: Kazunari Kirii, Aichi-ken, Japan

[73] Assignee: Toyota Jidosha Kabushiki Kaisha, Toyota, Japan

[21] Appl. No.: 246,748

[22] Filed: May 20, 1994

[30] Foreign Application Priority Data

May 25, 1993 [JP] Japan ..... 5-146925

[51] Int. Cl.[6] ..... B21D 24/08

[52] U.S. Cl. ..... 72/15.1; 72/350; 72/31.01

[58] Field of Search ..... 72/7, 31, 350, 72/351, 453.13, 15.1

[56] References Cited

U.S. PATENT DOCUMENTS

| | | | |
|---|---|---|---|
| 4,283,929 | 8/1981 | Heiberger | 72/7 |
| 4,909,061 | 3/1990 | Reitter et al. | 72/351 |
| 4,945,742 | 8/1990 | Schoch | 72/21 |
| 5,255,552 | 10/1993 | Bielfeldt | 72/351 |

FOREIGN PATENT DOCUMENTS

| | | |
|---|---|---|
| 0467297 | 1/1992 | European Pat. Off. . |
| 0566308 | 10/1993 | European Pat. Off. . |
| 60-108429 | 7/1985 | Japan . |
| 62-3219 | 1/1987 | Japan . |
| 62-20711 | 2/1987 | Japan . |
| 62-46125 | 3/1987 | Japan . |
| 1-60721 | 4/1989 | Japan . |
| 3-99730 | 4/1991 | Japan . |

*Primary Examiner*—Lowell A. Larson
*Attorney, Agent, or Firm*—Finnegan, Henderson, Farabow, Garrett and Dunner

[57] ABSTRACT

In a cushioning device of a press having a pneumatic cylinder for producing a blank-holding force to be applied to a blank through a cushion platen and a pressure ring, an optimum initial value of the pneumatic pressure of the pneumatic cylinder when the cushion platen is placed at a setup position lower than the lower stroke end is calculated based on die-set information relating to the pressure ring and including a predetermined optimum value of the blank-holding force, and machine information relating to the cushioning device, so that the calculated optimum initial pneumatic pressure provides the optimum blank-holding force during a pressing operation, irrespective of a volumetric increase of the pneumatic cylinder due to a movement of the cushion platen from the setup position to an operating position for the pressing operation. The pneumatic pressure is adjusted to the calculated optimum initial value when the cushion platen is located at the setup position.

15 Claims, 8 Drawing Sheets

METHOD AND APPARATUS FOR ADJUSTING PRESSURE OF CUSHIONING PNEUMATIC CYLINDER ON PRESS WHEN CUSHION PLATEN IS AT SETUP POSITION

BACKGROUND OF THE INVENTION

1. Field of the Invention

The present invention relates in general to a cushioning device for a press, and more particularly to a method and an apparatus for establishing an optimum pneumatic pressure in a cushioning pneumatic cylinder adapted to bias a cushion platen in an upward direction.

2. Discussion of the Related Art

A press adapted to effect a drawing operation on a blank is generally equipped with a cushioning device which includes (a) a cushion platen supporting a pressure member and (b) a cushioning pneumatic cylinder for biasing the cushion platen in an upward direction. The cushioning device is constructed to apply a blank-holding force to the pressure member to hold the blank placed on the pressure member, based on a pneumatic pressure of the cushioning pneumatic cylinder. An example of a press equipped with such a cushioning device is disclosed in laid-open Publication No. 62-20711 (published in 1987) of unexamined Japanese Utility Model Application. Usually, the pneumatic pressure of the cushioning pneumatic cylinder is adjusted so as to obtain an intended product from the blank, in a trial-and-error procedure by performing test pressing operations each time a die set used on the press is changed.

However, the adjustment of the pneumatic pressure in the trial-and-error procedure as described above is not only cumbersome and time-consuming, but also requires a relatively high level of skill of the operator and suffers from difficulty in producing pressed articles with consistently high quality. In view of this drawback, there has been proposed a method of automatically adjusting the pneumatic pressure of the cushioning pneumatic cylinder to an optimum value suitable for the intended product, on the basis of die-set information indicative of specifications of a die set used, and machine information indicative of the specifications of the press in question, as disclosed in co-pending application No. 08/043,822. Described more specifically by reference to FIG. 1, an optimum value Pax of a pneumatic pressure Pa of a cushioning pneumatic cylinder 32 used in a press shown in the figure is calculated according to the following equation (1), and the pneumatic pressure Pa is adjusted to the calculated optimum value Pax by suitably controlling a pneumatic pressure control circuit 38 and a shut-off valve 37 while the actual pneumatic pressure Pa is detected by a pneumatic pressure sensor 39:

$$Pax=(Fso+Wa+Wr+n\cdot Wp)/A \quad (1)$$

where, Fso: optimum blank-holding force for an intended drawing operation,

Wr: weight of a pressure ring 28 (pressure member), n: number of cushion pins 22, Wa: weight of cushion platen 26, Wp: weight of each cushion pin 22, A: pressure-receiving area of the cylinder 32.

The optimum blank-holding force Fso, weight Wr of the pressure ring 28 and number n of the cushion pins 22 used in the above equation (1) are determined for each die set used, by test pressing operations on a try press or test press (namely, a press on which test pressing operations are performed using a new die set, to find out optimum pressing conditions for obtaining an intended product).

When the die set is changed from one to another or when the new die set is installed on the press, the supply of compressed air to the cushioning pneumatic cylinder 32 and the adjustment of the pneumatic pressure of the cylinder 32 are conducted while the cushion platen 26 is placed at its lowermost position at which the upper die 18 is attached to a press slide 20. In other words, the pneumatic pressure adjustment is effected while the upper die 18 is attached to the press slide 20. The pneumatic pressure adjustment concurrently with the attachment of the upper die 18 to the press slide 20 advantageously shortens the overall time required for the changeover involving the attachment of the die set and the pneumatic pressure adjustment. On the other hand, however, a subsequent upward movement of the cushion platen 26 from its lowermost position to an operating position for a pressing operation will cause an increase in the volume of the pneumatic cylinder 32 and a resulting decrease in the pneumatic pressure. Consequently, the pneumatic pressure of the pneumatic cylinder should be raised by supplying an additional amount of compressed air to the pneumatic cylinder, prior to a pressing operation in which the lower stroke end of the cushion platen 26 is located above its lowermost position. This re-adjustment of the pneumatic pressure requires an additional time before starting the pressing operation. In other words, the commencement of the pressing operation is accordingly delayed due to the requirement for the re-adjustment of the pneumatic pressure.

SUMMARY OF THE INVENTION

It is therefore a first object of the present invention to provide a method of adjusting the pneumatic pressure of the cushioning pneumatic cylinder when the cushion platen is placed at its lowermost position, which method assures an optimum blank-holding force applied to the blank during a pressing operation on the blank.

A second object of the invention is to provide an apparatus suitable for practicing the method indicated above.

The first object may be achieved according to one aspect of the present invention, which provides a method of adjusting a pneumatic pressure in a cushioning pneumatic cylinder of a cushioning device of a press so as to adjust a blank-holding force to a predetermined optimum value during a pressing operation on a blank, the cushioning device including a pressure ring and a cushion platen supporting the pressure ring, and providing the blank-holding force based on the pneumatic pressure in the pneumatic cylinder, such that the blank-holding force is applied to the blank through the cushion platen and the pressure ring while the cushion platen is moved between an upper and a lower stroke end during the pressing operation, the method comprising the steps of: (a) calculating an optimum initial value of the pneumatic pressure as measured when the cushion platen is placed at a setup position lower than the lower stroke end, on the basis of die-set information relating to the pressure ring and including the predetermined optimum value of the blank-holding force, and machine information relating to the cushioning device, the optimum initial value providing the predetermined optimum value of the blank-holding force during the pressing operation, irrespective of an increase in a volume of the pneumatic cylinder due to a movement of the cushion platen from the setup position to an operating position for the pressing operation; and (b) adjusting the pneumatic pressure to the calculated optimum initial value when the cushion platen is located at the setup position.

According to the pneumatic pressure adjusting method of the present invention described above, the optimum initial value of the pneumatic pressure of the cushioning pneumatic cylinder as measured when the cushion platen is located at its setup position is calculated on the basis of the die-set information and the machine information, so as to provide the optimum blank-holding force during a pressing operation on the blank, and the pneumatic pressure is adjusted to the calculated initial optimum value when the cushion platen is located at its setup position lower than the lower stroke end. When the pressing operation is effected after the cushion platen is moved up to its upper stroke end, the optimum blank-holding force acts on the blank through the cushion platen and pressure member, based on the pneumatic pressure whose initial value as measured when the cushion platen is at its setup position has been adjusted to the optimum value when the cushion platen is at its setup position.

The present method assures easy and fast setup of the press when the new die set (upper and lower dies and the pressure ring) is installed on the press. For instance, the press slide is first lowered to its lower stroke end, and the upper die is attached to the press slide. While the upper die is attached to the press slide placed at its lower stroke end, the cushion platen is located at its setup position which is lower than its lower stroke end. In this condition, the pneumatic pressure of the cushioning pneumatic cylinder is adjusted with compressed air fed into the pneumatic cylinder. More specifically, the initial value of the pneumatic pressure as measured when the cushion platen is at its setup position is adjusted to the calculated optimum value while the upper die is attached to the press slide with the cushion platen located at its setup position. Thus, the present method eliminates the conventionally required re-adjustment of the pneumatic pressure after the cushion platen is restored to the upper stroke end so as to be ready for a pressing operation. Accordingly, the non-productive time prior to the commencement of a pressing job can be significantly reduced, and the production efficiency of the press is accordingly improved.

The die-set information which includes the predetermined optimum blank-holding force Fso may further includes the weight Wr of the pressure member, and the machine information may include the weight Wa of the cushion platen and the pressure-receiving area A of the pneumatic cylinder. The die-set information and machine information may further include data which relate to the volumetric increase of the pneumatic cylinder due to the movement of the cushion platen from the setup position to the operating position (e.g., upper stroke end). The data relating to this volumetric increase may include: the operating stroke of the cushion platen during a pressing cycle, as part of the die-set information; and axial dimensions of the air chamber of the pneumatic cylinder when the cushion platen is located at the setup position and the upper stroke end, respectively, and a volume of an air tank communicating with the pneumatic cylinder, as part of the machine information.

The second object indicated above may be achieved according to a second aspect of this invention, which provides an apparatus for adjusting a pneumatic pressure in a cushioning pneumatic cylinder of a cushioning device of a press so as to adjust a blank-holding force to a predetermined optimum value during a pressing operation on a blank, the cushioning device including a pressure ring and a cushion platen supporting the pressure ring, and providing the blank-holding force based on the pneumatic pressure in the pneumatic cylinder, such that the blank-holding force is applied to the blank through the cushion platen and the pressure ring while the cushion platen is moved between an upper and a lower stroke end during the pressing operation, the apparatus comprising: (a) input means for entering die-set information relating to the pressure ring and including the predetermined optimum value of the blank-holding force; (b) machine data memory means for storing machine information relating to the cushioning device; (c) calculating means for calculating an optimum initial value of the pneumatic pressure as measured when the cushion platen is placed at a setup position lower than the lower stroke end, on the basis of the die-set information and the machine information, the optimum initial value of the pneumatic pressure providing the predetermined optimum value of the blank-holding force during the pressing operation, irrespective of an increase in a volume of the pneumatic cylinder due to a movement of the cushion platen from the setup position to an operating position for the pressing operation; and (d) adjusting means for adjusting the pneumatic pressure to the calculated optimum initial value when the cushion platen is located at the setup position.

The pneumatic pressure adjusting apparatus of the present invention constructed as described above is capable of effecting automatic adjustment of the initial value of the pneumatic pressure of the cushioning pneumatic cylinder according to the method described above, that is, capable of automatically adjusting the pneumatic pressure of the cushioning pneumatic cylinder to the calculated optimum initial value when the cushion platen is located at its setup position. The optimum initial pneumatic pressure value is calculated by the calculating means on the basis of the die-set information entered through the input means, and the machine information stored in the machine data memory means. The adjusting means operates when the cushion platen is located at its setup position, to automatically adjust the pneumatic pressure to the calculated optimum initial value. This automatic adjustment of the pneumatic pressure reduces the operator's workload in setting up the operation of the press involving the installation of the new die set and the adjustment of the pneumatic pressure. Further, the automatic adjustment of the pneumatic pressure avoids inadequate adjustment of the pneumatic pressure due to erroneous manipulation of the press by the operator.

BRIEF DESCRIPTION OF THE DRAWINGS

The above and additional objects, features and advantages of the present invention will become more apparent by reading the following detailed description of a presently preferred embodiment of the invention, when considered in conjunction with the accompanying drawings, in which.

DETAILED DESCRIPTION OF THE PREFERRED EMBODIMENT

Figure 1:
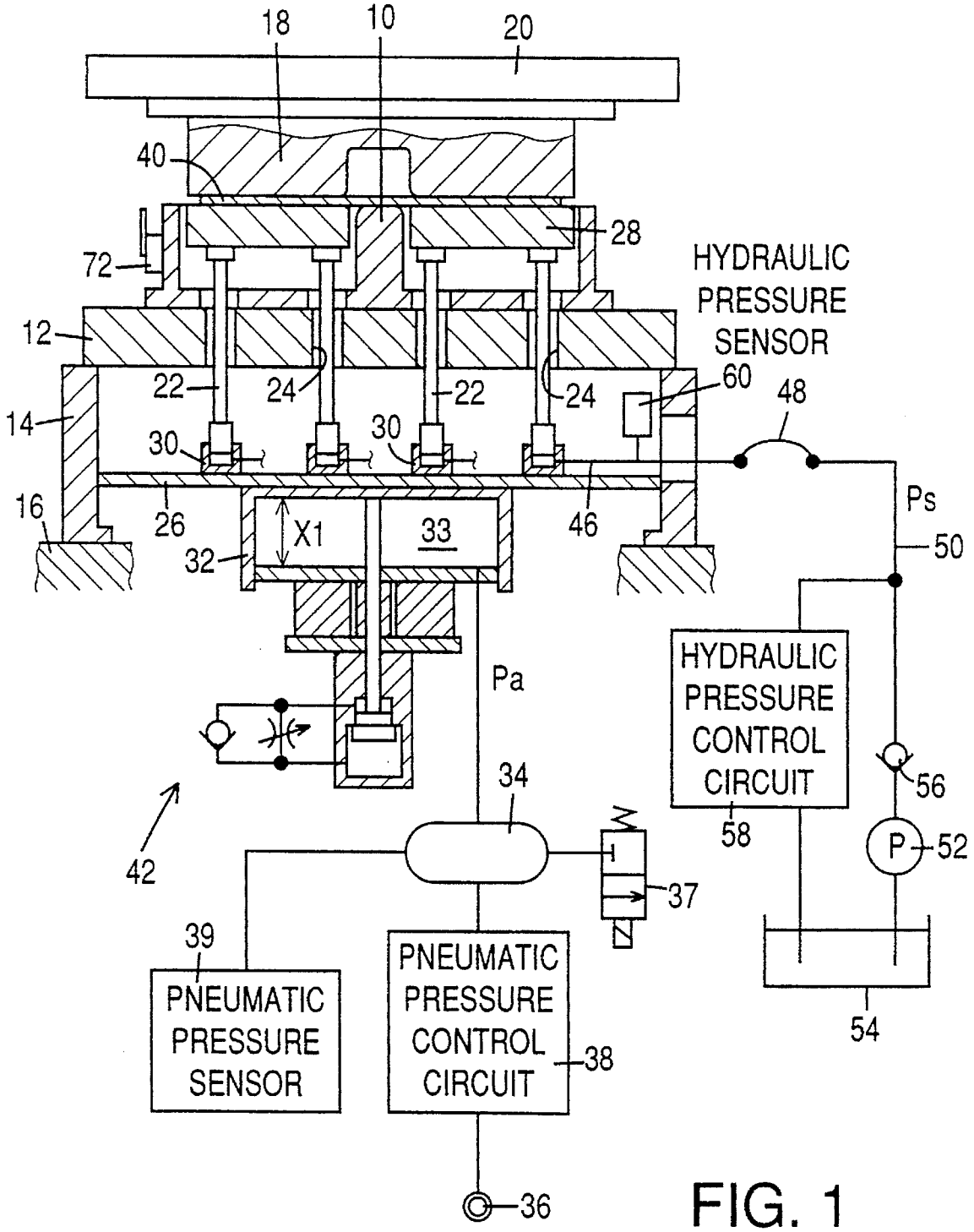
FIG. 1 is a schematic view illustrating a press equipped with a cushioning device, for which there is provided a pneumatic pressure adjusting apparatus constructed according to one embodiment of the present invention.

Referring first to FIG. 1 showing one example of a press adapted to effect a drawing operation to produce an outer panel for a motor vehicle, for instance. In the present press, a lower die in the form of a punch 10 is mounted on a bolster 12 disposed on a carrier 14 resting on a machine base 16, while an upper die 18 is carried by a press slide 20 which is vertically reciprocated by a drive mechanism well known in the art. The bolster 12 has a multiplicity of through-holes 24 through which respective cushion pins 22 extend in the direction of reciprocation of the press slide 20. The cushion pins 22 are supported at their lower ends by a cushion platen 26 disposed below the bolster 12.

The cushion pins 22 are provided to support, at their upper ends, a pressure member in the form of a pressure ring 28 which is disposed so as to surround the working portion of the punch 10. The number of the cushion pins 22 and their positions relative to the pressure ring 28 are determined as needed depending upon the size and shape of the pressure ring 28, for example. The cushion platen 26 is provided with a multiplicity of balancing hydraulic cylinders 30 disposed thereon in alignment with the respective through-holes 24 formed through the bolster 12. The hydraulic cylinders 30 have housings secured to the upper surface of the cushion platen 26, and pistons which are held in abutting contact with the lower end faces of the respective cushion pins 22. The punch 10, die 18 and pressure ring 28, which serve as the lower die, upper die and pressure member, respectively, cooperate with each other to provide a die set.

The cushion platen 26 is disposed within the press carrier 14 and supported by a cushioning pneumatic cylinder 32, such that the platen 26 is movable in the direction of reciprocation of the press slide 20 and is biased by the cylinder 32 in the upward direction. The pneumatic cylinder 32 has an air chamber 33 communicating with an air tank 34, which stores compressed air having a pneumatic pressure Pa supplied from an air pressure source 36 via a pneumatic pressure control circuit 38. To the air tank 34, there are connected a shut-off valve 37 and a pneumatic pressure sensor 39. The pneumatic pressure Pa in the air tank 34 and pneumatic cylinder 32 is adjusted by the pressure control circuit 38 and shut-off valve 37, depending upon a desired blank-holding force Fs to be applied to the pressure ring 28. Described in detail, a blank 40 in the form of a metal strip to be drawn into a desired product or article is placed on the pressure ring 28 before a pressing or drawing operation on the blank 40 is started with a downward movement of the press slide 20 with the upper die 18. As the press slide 20 is moved down to a given point, the upper die 18 forces an outer portion of the blank 40 against the pressure ring 28, whereby the blank 40 is held in place prior to a drawing action on the blank 40 between the upper and lower dies 18, 10. As a result, the pneumatic cylinder 32 is pressed down via the pressure ring 28, cushion pins 22, hydraulic cylinders 30 and cushion platen 26, whereby a reaction force corresponding to the pneumatic pressure Pa of the cylinder 32 acts on the pressure ring 28 as the blank-holding force or cushioning force, as well known in the art.

While the single pneumatic cylinder 32 is provided in the present embodiment, two or more cushioning pneumatic cylinders 32 may be provided. In this case, the air chambers 33 of the pneumatic cylinders 32 are connected to the common air tank 34.

The balancing hydraulic cylinders 30 have respective fluid chambers communicating with each other by a manifold 46, which is connected to a fluid passage 50 through a flexible tube 48. The fluid passage 50 is connected to a pneumatically operated hydraulic pump 52, which operates to pressurize a working fluid sucked up from an oil tank 54. The pressurized fluid is supplied from the pump 52 to the fluid passage 50 through a check valve 56. To the fluid passage 50, there is connected a hydraulic pressure control circuit 58 provided with a pressure relief valve. The hydraulic pressure control circuit 58 and the pump 52 cooperate to adjust a hydraulic pressure Ps in the passage 50 and hydraulic cylinders 30. The hydraulic pressure Ps is detected by a hydraulic pressure sensor 60 connected to the manifold 46. The hydraulic pressure Ps of the hydraulic cylinders 30 is adjusted so that the blank-holding force Fs is evenly distributed by the hydraulic cylinders 30 on all of the cushion pins 22, that is, so that the pistons of all of the hydraulic cylinders 30 are placed at their neutral positions (between their upper and lower stroke ends) during a pressing action on the blank 40.

Figure 2:
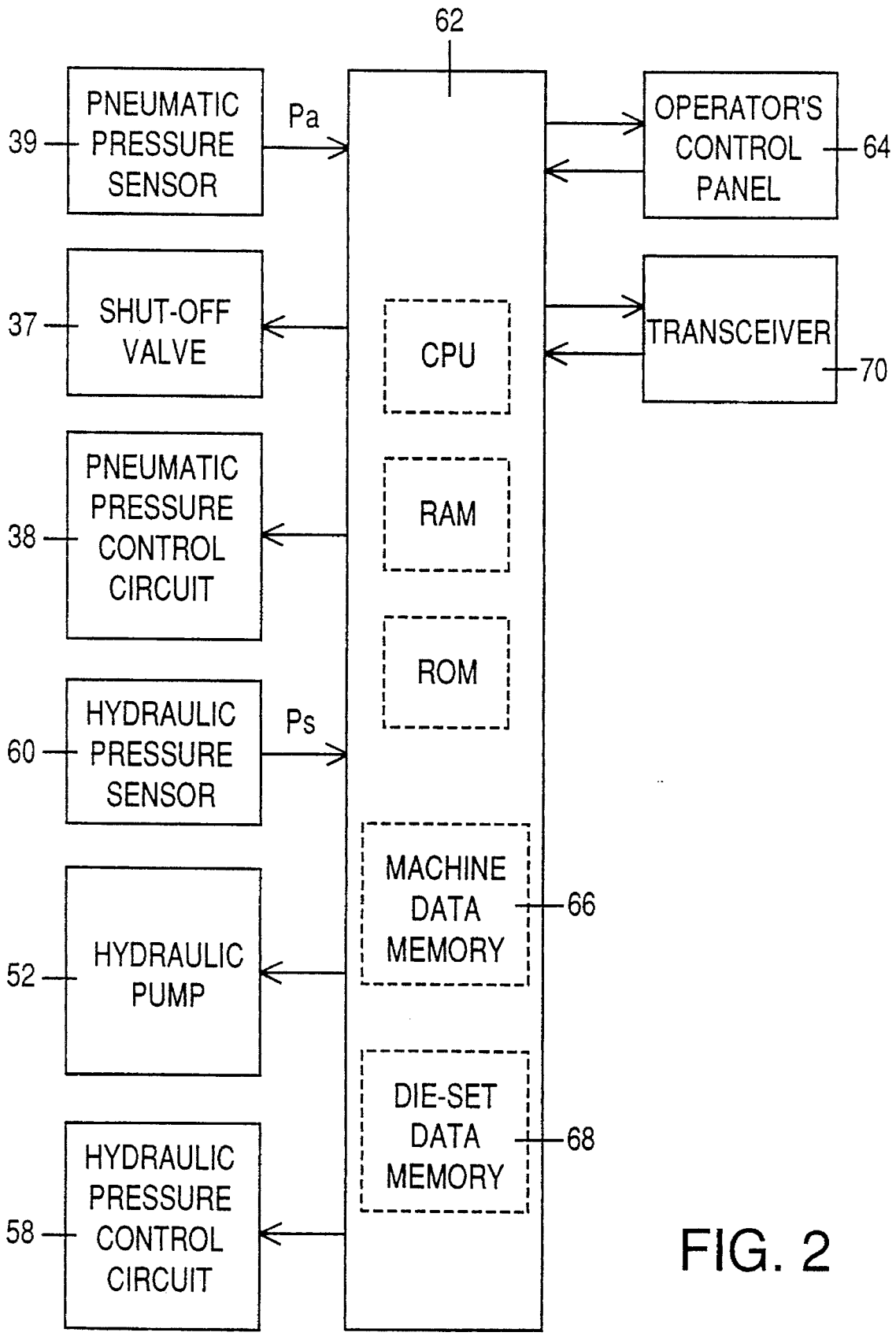
FIG. 2 is a block diagram illustrating an arrangement of a control system of the press of FIG. 1.
Figure 3:
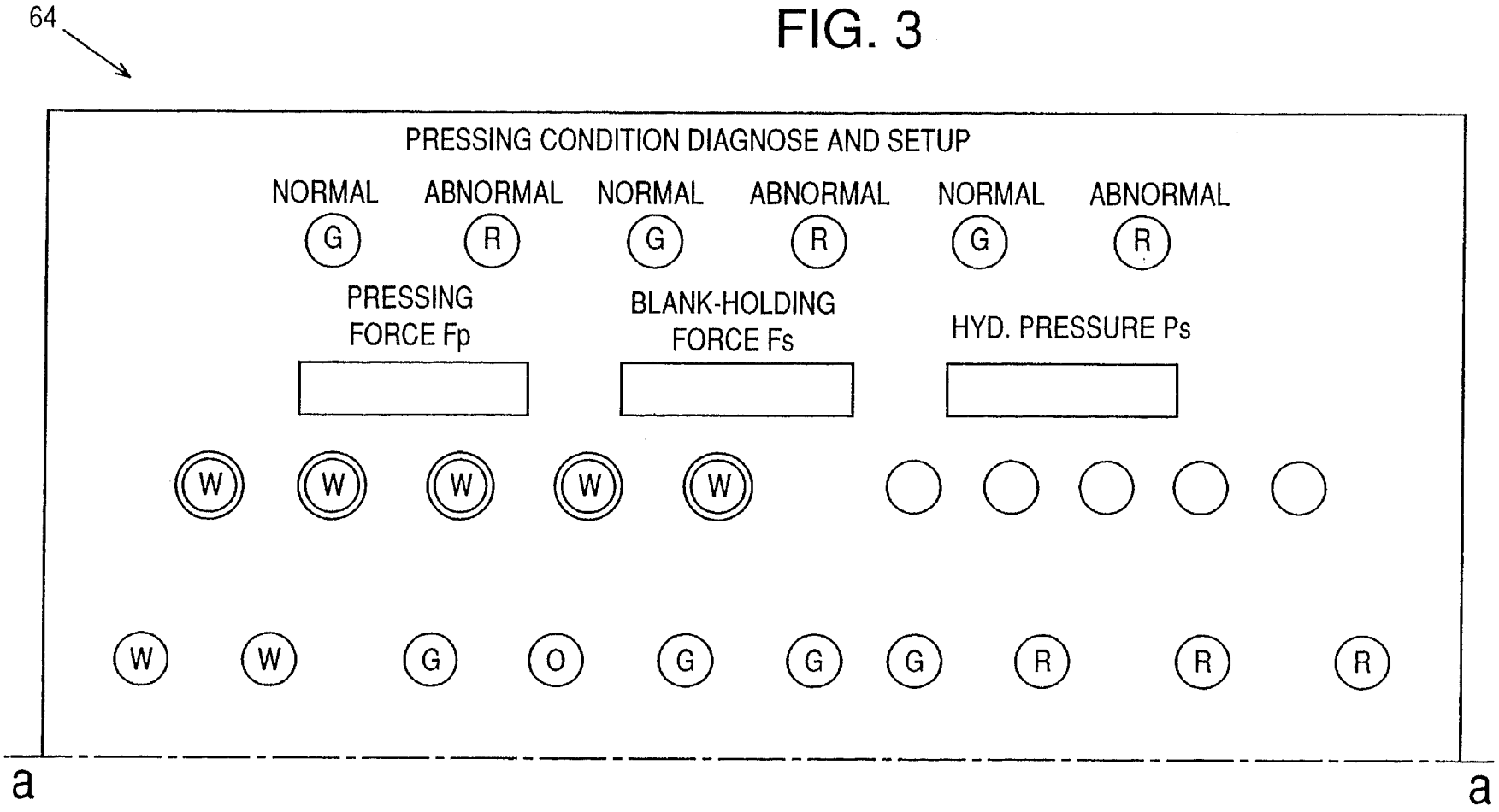
FIGS. 3, 4 and 5 are views showing an operator's control panel used in the control system of FIG. 2.
Figure 4:
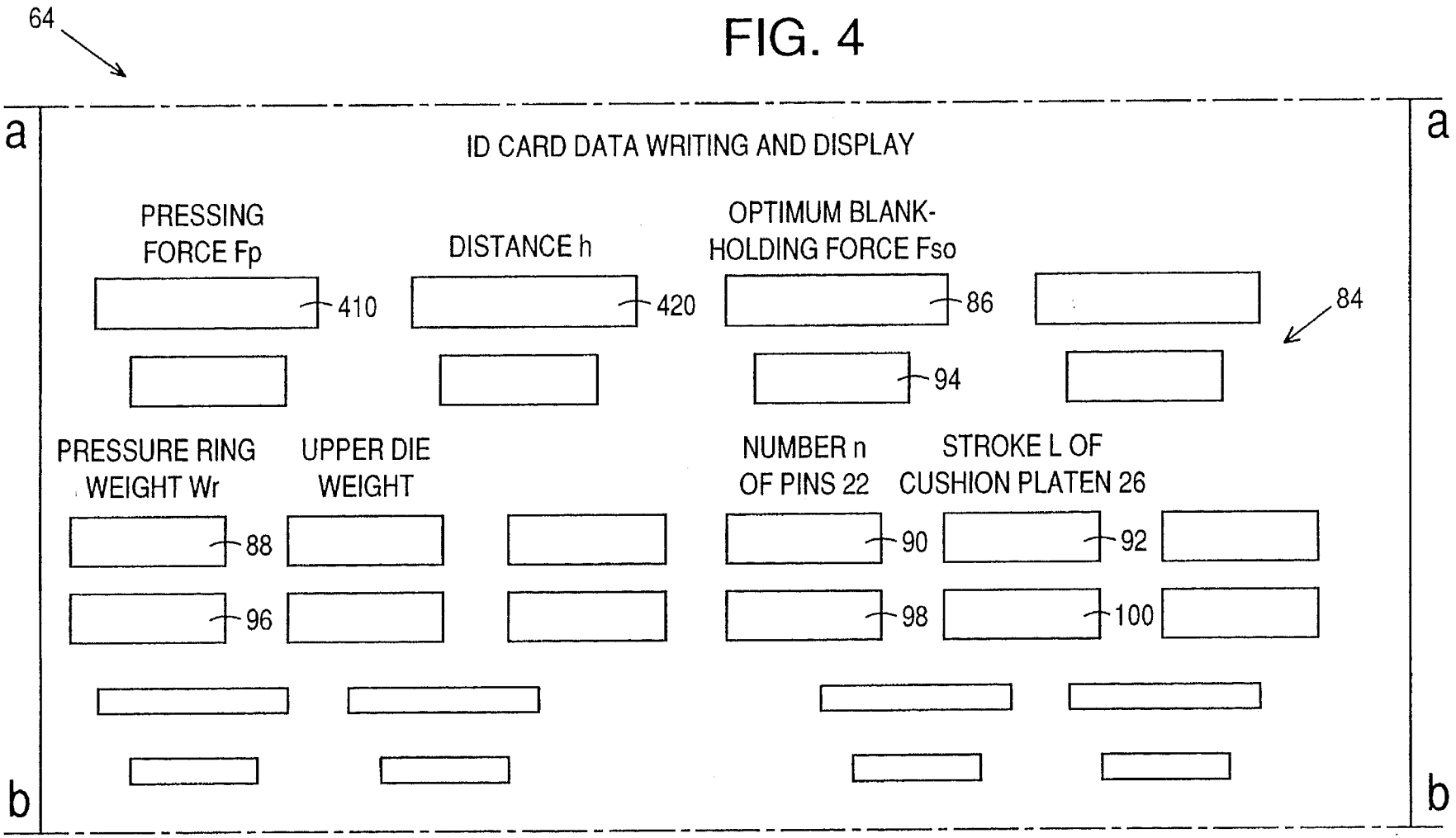
Figure 5:
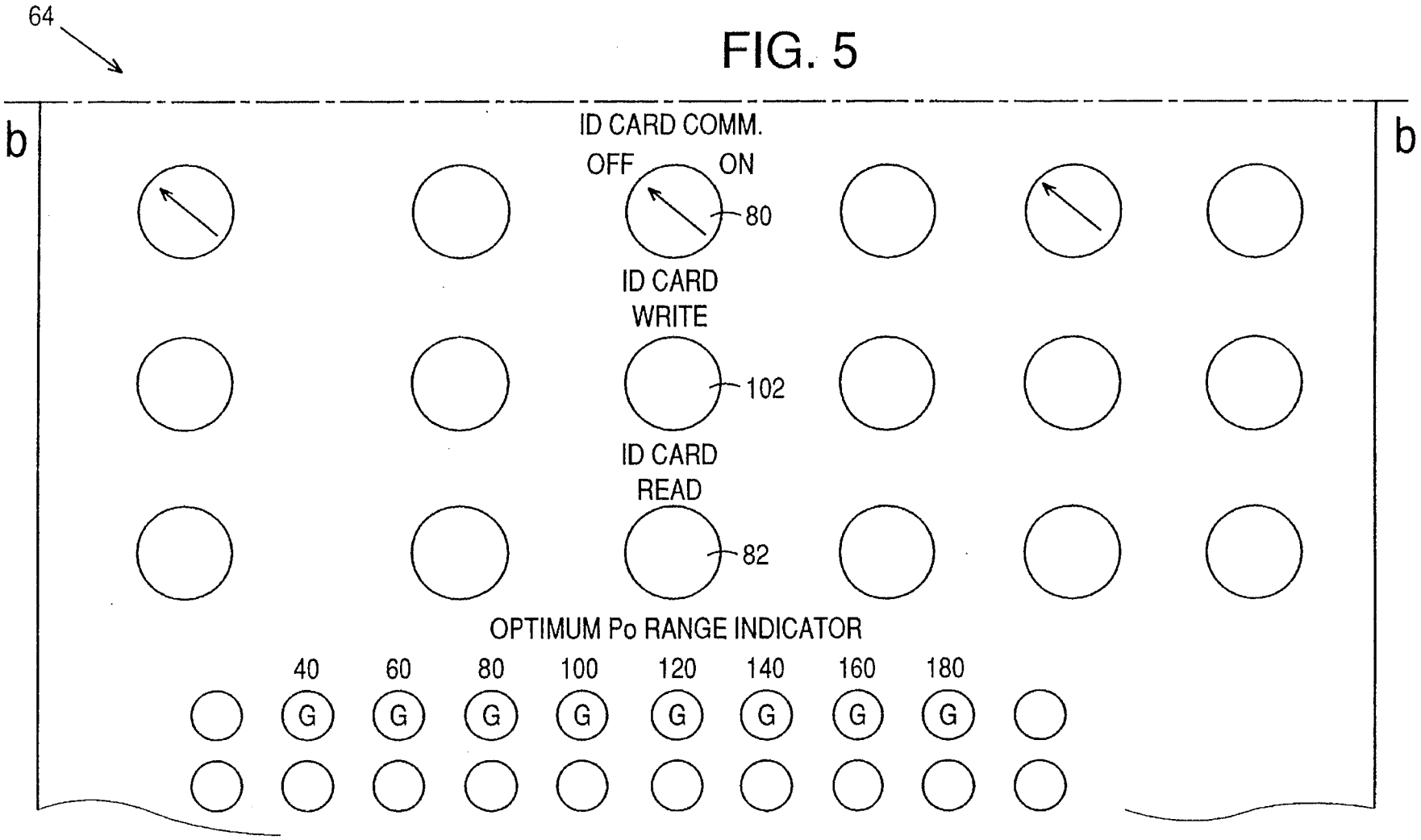

In the present embodiment of the invention, the cushioning pneumatic cylinder 32, cushion platen 26, balancing hydraulic cylinders 30 and cushion pins 22 constitute a major portion of a cushioning device indicated generally at 42. The pneumatic pressure Pa and the hydraulic pressure Ps of the cushioning device 42 are controlled or adjusted by a control unit 62 illustrated in FIG. 2. The control unit 62 receives output signals of the pneumatic pressure sensor 39 and hydraulic pressure sensor 60 indicative of the pneumatic and hydraulic pressure values Pa, Ps, through amplifiers and A/D converters. The control unit 62 incorporates a microcomputer including a central processing unit (CPU), a random-access memory (RAM), and a read-only memory (ROM). The microcomputer operates according to various control programs stored in the ROM, to control the shut-off valve 37, pneumatic and hydraulic pressure control circuits 38, 58 and hydraulic pump 52, for adjusting the pneumatic and hydraulic pressures Pa, Ps. The control unit 62 is also connected to an operator's control panel 64 shown in FIGS. 3 through 5. The control panel 64 has various switches and indicators.

Figure 6:
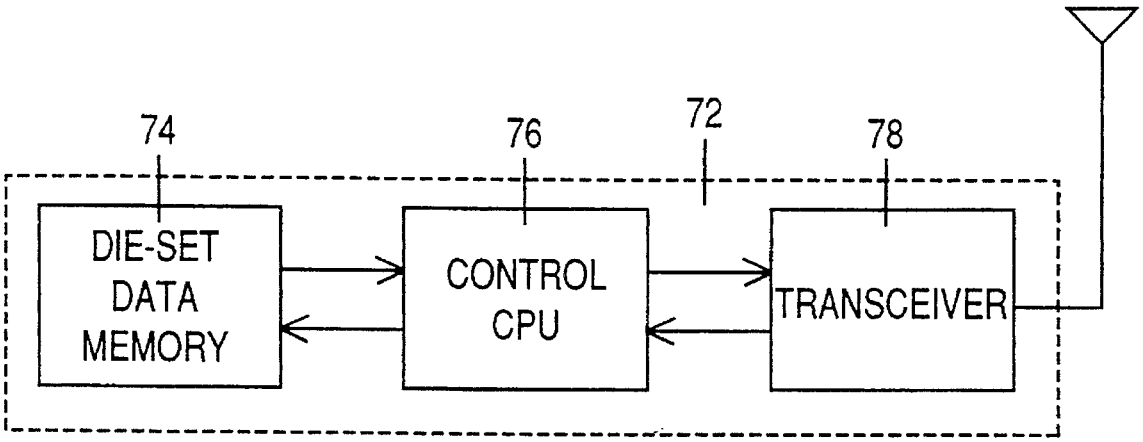
FIG. 6 is a block diagram view explaining function of an ID card attached to a punch installed on the press.

The control unit 62 further incorporates a machine data memory 66 and a die-set data memory 68. The machine data memory 66 stores machine information which is entered through suitable means such as a keyboard or received from an external device such as a personal computer. The machine information is indicative of specifications of the press. The die-set data memory 68 stores die-set information which is received through a transceiver 70 from an ID card 72 attached to the punch 10 as indicated in FIG. 1. The die-set information is indicative of the specification of the die set 10, 18, 28. As illustrated in the functional block diagram of FIG. 6, the ID card 72 includes a die-set memory 74 which stores the die-set information, a control CPU 76, a transceiver 78, and a buttery. The ID card 72 is adapted to send the die-set information to the control unit 62 through the transceiver 70, in response to a signal received from the transceiver 70.

The machine information and the die-set information are information necessary to determine the pneumatic pressure Pa and other operating conditions of the press, which are optimum for effecting an intended drawing operation on the blank 40 using the specific die set 10, 18, 28. The machine information and die-set information include the following items. It is noted that the die-set information includes data indicative of the specific die set used, which differs depending upon the product to be produced, a model of a car for which the product is used, a type of a press on which the die set is used, and a process in which the product is produced from the blank.

Machine Information

Weight Wa of the cushion platen 26

Average weight Wp of the cushion pins 22

Pressure-receiving area A of the pneumatic cylinder 32

Initial axial dimension Xo of the air chamber 33

Upper end axial dimension X1 of the air chamber 33

Volume Va of the air tank 34

Die-Set Information

Weight Wr of the pressure ring 28

Optimum blank-holding force Fso

Number n of the cushion pins 22

Operating stroke L of the cushion platen 26 during a pressing action

Figure 7:
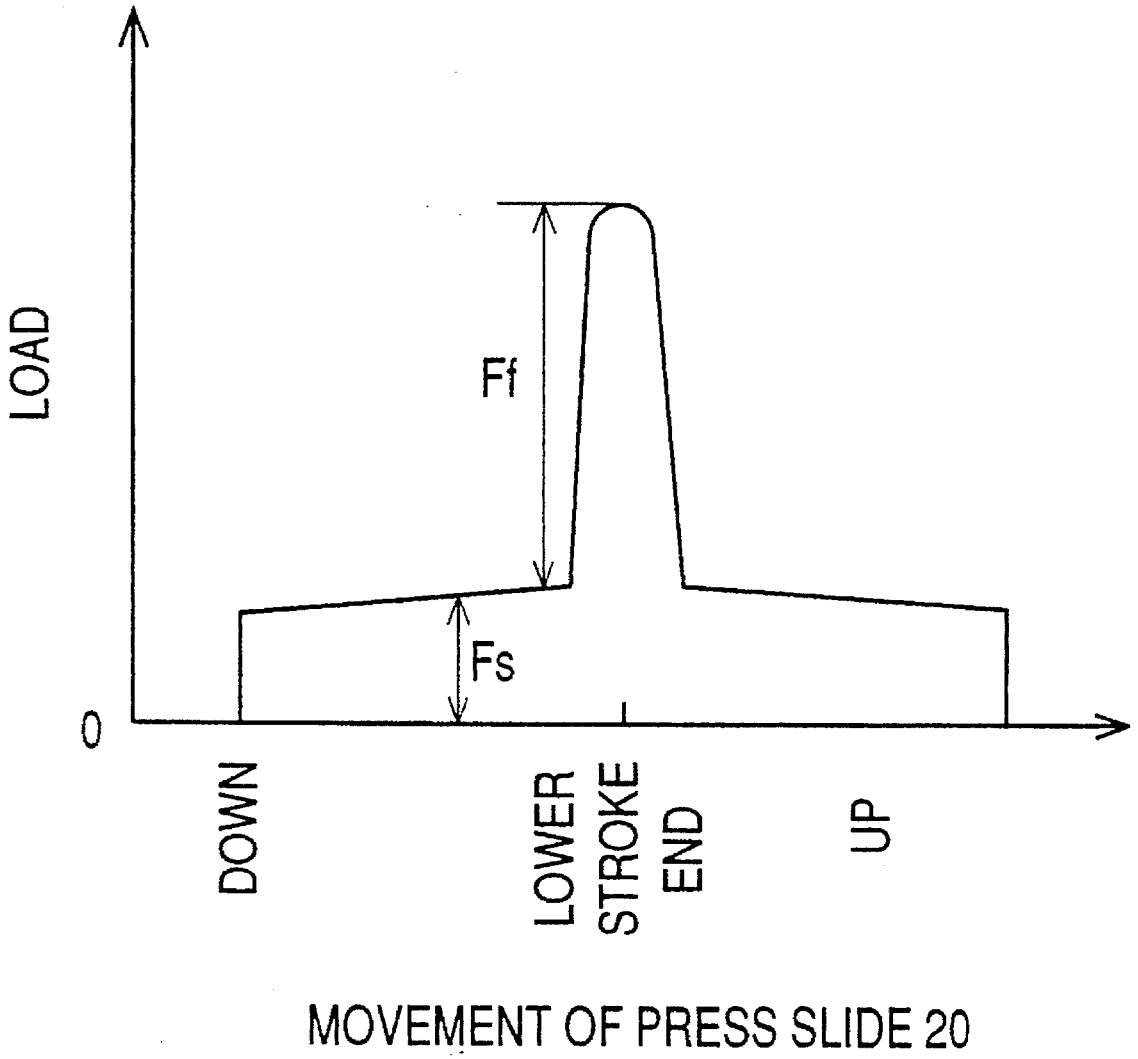
FIG. 7 is a graph explaining a waveform of a press load in relation to a reciprocating movement of a press slide, the press load including a blank-holding force.

The weight Wa of the cushion platen 26 and the pressure-receiving area A of the pneumatic cylinder 32 are theoretical or nominal values, or actually measured values. However, it is desirable that the weight Wa and area A be obtained by measurement using a load measuring apparatus as disclosed in co-pending application No. 08/043,864, so that the values Wa, A used reflect the actual operating conditions of the cushion platen 26 and the pneumatic cylinder 32, such as the resistance to the sliding movement of the cushion platen 26. Where the two or more pneumatic cylinders 32 are used, the pressure-receiving area A is the total pressure-receiving area of all the pneumatic cylinders 32. The average weight Wp of the cushion pins 22 is an average of the weights of the cushion pins 22 used on the press. The weight Wr of the pressure ring 28 is an actual measured value. The optimum blank-holding force Fso is a value measured in a trial-and-error procedure so as to obtain intended quality of the product, by using strain sensors attached to plungers for vertically reciprocating the press slide 20, or a machine frame of the press, as disclosed in co-pending application No. 08/144,513. The load on the press during a pressing action on the blank 40 varies with a reciprocating movement of the press slide 20, as indicated in the graph of FIG. 7. It will be understood from the graph that the blank-holding force Fs between the upper die 18 and the pressure ring 28 increases as the press slide 20 is moved toward the lower stroke end or as the volume of the air chamber 33 of the pneumatic cylinder 32 decreases. The optimum blank-holding force Fso is the value of the blank-holding force Fs when the press slide 20 is located at its lower stroke end or a point near the lower stroke end. It is noted that a load Ff indicated in FIG. 7 is a forming force between the punch 10 and the upper die 18, which acts on the blank 40 to form the blank into the product. The number n of the cushion pins 22 is determined to assure intended quality of the product, depending upon the shape and other parameters of the pressure ring 28. The operating stroke L of the cushion platen 26 is a distance of downward movement of the cushion platen 26 during a pressing action on the blank 40.

The initial axial dimension Xo of the air chamber 33 is an axial dimension of the air chamber 33 when the cushion platen 26 is locked at its lowermost position, namely, at its setup position at which the pneumatic pressure Pa is adjusted upon installation of a new die set 10, 18, 28. The setup position of the cushion platen 26 is located below the lower stroke end of the cushion platen 26 during a pressing cycle, and is established with the air chamber 33 being drained. The upper end axial dimension X1 is an axial dimension of the air chamber 33 when the cushion platen 26 is held at its upper stroke end, by the pneumatic cylinder 32, as indicated in FIG. 1. The volume Va of the air tank 34 is a total volume of the pneumatic system (except the air chamber 33), which includes the volume of the tank 34 and the air passage communicating with the tank 34. While the values Xo, X1 and Va may be either theoretical or nominal values, or actually measured values, it is desirable to determine these values by measurement during test operations. That is, since $Vo=Va+A\cdot Xo$, and $V_L=Va+A\cdot(X1-L)$, while $Po\cdot Vo=P_L\cdot V_L$, the following equation (2) is obtained:

$$Po/P_L=V_L/Vo=\{Va+A(X1L)\}/(Va+A\cdot Xo) \quad (2)$$

where,

Vo: total volume of the pneumatic system when the cushion platen 26 is located at its setup position, Po: initial value of the pneumatic pressure Pa as measured when the cushion platen 26 is located at its setup position, $V_L$: total volume of the pneumatic system as measured when the press slide 20 is located at its lowermost position, namely, after the cushion platen 26 has been lowered from its uppermost position by a distance equal to the operating stroke L, $P_L$: lower end value of the pneumatic pressure Pa corresponding to $V_L$.

Since the values Po and $P_L$ can be measured by the pneumatic pressure sensor 39, and the pressure-receiving area A and the operating stroke L are known, the three unknown values Xo, X1 and Va can be obtained from the above equation (2), on the basis of the measured pneumatic pressure values PL which correspond to three different initial values Po that are suitably selected. It is noted that the operating stroke L of the cushion platen 26 is determined by the die set 10, 18, 28. The die set used for the measurement of the values Xo, X1 and Va may be replaced by a suitable load measuring block prepared so as to define the operating stroke L.

The above values Xo, X1 and Va may be obtained by a single test pressing cycle in which three pneumatic pressure values Pa are measured at respective three different positions of the press slide 20 during movement of the press slide 20 in an inching mode. The values Xo, X1 and Va may also be obtained according to the following equation (3):

$$Po/P1=V1/Vo=\{Va+A(X1-L)\}/(Va+A\cdot Xo) \quad (3)$$

where, $V1=Va+A\cdot X1$: total volume of the pneumatic system when the cushion platen 26 is located at its upper stroke end, P1: Pneumatic pressure Pa when the cushion platen 26 is located at its upper stroke end.

Referring next to the flow chart of FIG. 8, there will be described a method of adjusting the pneumatic pressure Pa upon exchanging of the die sets or installation of the new die set 10, 18, 28. When the new die set 10, 18, 28 is installed on the press, the bolster 12 is first located outside the press, then loaded with the punch 10, and the pressure ring 28 and the upper die 18 both placed on the punch 10, and moved to a predetermined operating position within the press. The upper die 18 is then attached to the press slide 20, with the cushion platen 26 locked at its lowermost position or setup position with the pneumatic cylinder 32 being drained. The adjustment of the pneumatic pressure Pa of the pneumatic cylinder 32 is effected concurrently with the operation to attach the upper die 18 to the press slide 20, namely, while the cushion platen 26 is locked at its setup position, by suitable locking means such as a hydraulic brake.

Figure 8:
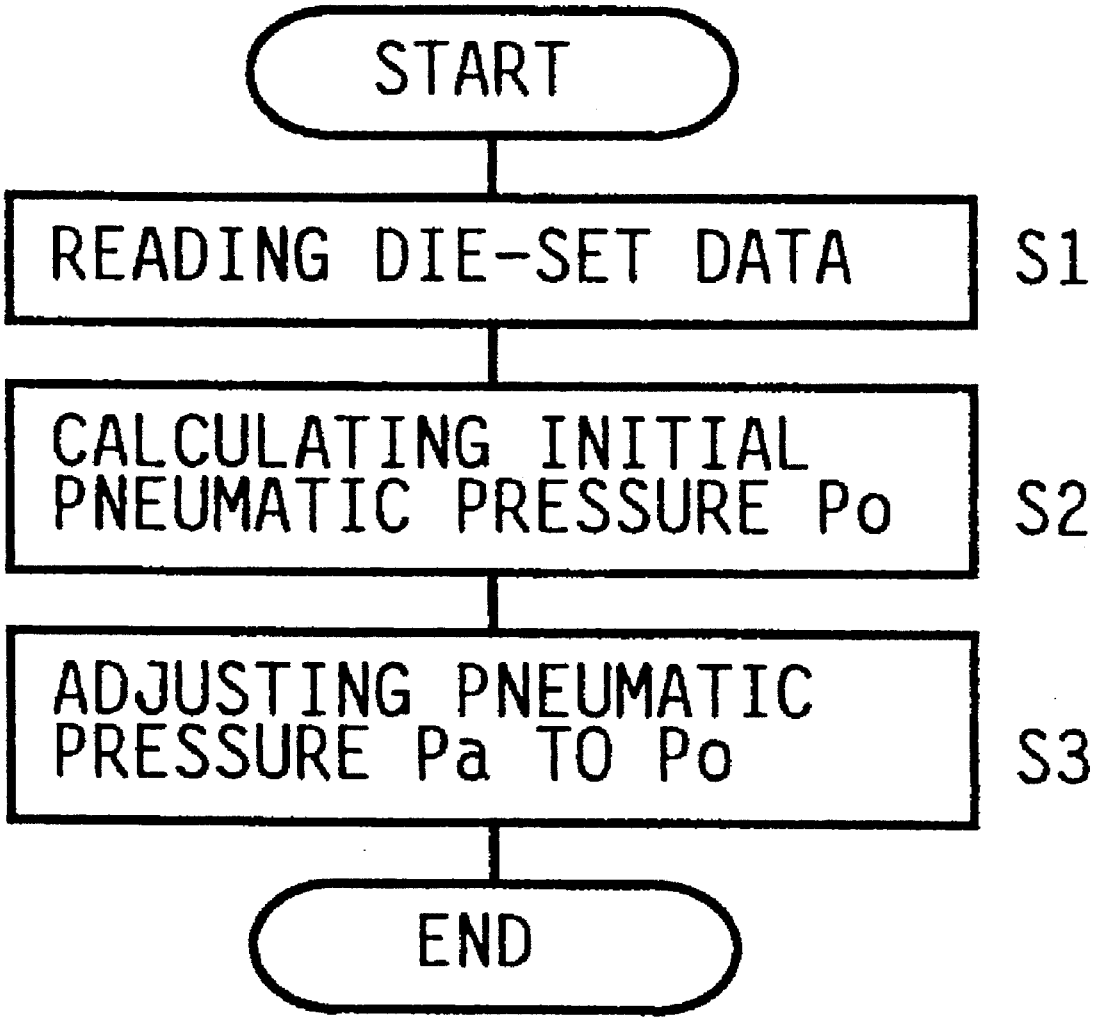
FIG. 8 is a flow chart illustrating an operation of the pneumatic pressure adjusting apparatus to adjust the pneumatic pressure of the cushioning device.

A routine illustrated in FIG. 8 is stored in the ROM of the control unit 62, and is executed when an ID CARD READ pushbutton 82 on the operator's control panel 64 is depressed after an ID CARD COMM. selector switch 80 also provided on the control panel 64 is turned to an 0N position. The routine is initiated with step S1 to read the die-set information received from the ID card 72 attached to the punch 10, store the received die-set information in the die-set data memory 68, and display the die-set information on a display section 84 of the control panel 64. The display section 86 includes an indicator 86 for indicating the optimum blank-holding force Fso, an indicator 88 for indicating the weight Wr of the pressure ring 28, an indicator 90 for indicating the number n of the cushion pins 22, and an indicator 92 for indicating the operating stroke L of the cushion platen 26.

Step S1 is followed by step S2 to calculate the initial pneumatic pressure Po according to the following equation (4), on the basis of the machine information stored in the machine data memory 66 and the die-set information stored in the die-set data memory 68:

$$\begin{aligned} Po &= Pax \cdot \{Va + A(X1 - L)\}/(Va + A \cdot Xo) \\ &= (Fso + Wa + Wr + n \cdot Wp)/A \cdot \\ &\quad \{Va + A \cdot (X1 - L)\}/(Va + A \cdot Xo) \end{aligned} \tag{4}$$

Then, the control flow goes to step S3 to control the pneumatic pressure control circuit 38 and shut-off valve 37 for adjusting the pneumatic pressure Pa to the calculated initial value Po, while detecting the pneumatic pressure Pa by the pneumatic pressure sensor 39.

The above equation (4) is formulated to calculate the optimum initial pneumatic pressure Po for obtaining the optimum blank-holding force Fso during a pressing action, irrespective of a volumetric change of the pneumatic cylinder 32. The equation (4) is obtained by substituting the optimum pneumatic pressure value Pax for the pneumatic pressure value $P_L$ in the above equation (2), so that the pneumatic pressure value $P_L$ when the press slide 20 is at its lower stroke end is equal to the optimum value Pax obtained according to the above equation (1). With the pneumatic pressure Pa adjusted in step S3 to the initial value Po calculated according to the equation (4), the pneumatic pressure $P_L$ at the lower stroke end of the press slide 20 coincides with the optimum value Pax as calculated according to the above equation (1), when a pressing operation takes place with the cushion platen 26 being unlocked. Thus, the pressing operation is conducted with the optimum blank-holding force Fso applied to the blank 40, i.e., to the pressure ring 28. It is noted that the weight Wr of the pressure ring 28 used for forming outer panels of a motor vehicle is generally 10 tons or smaller, and is considerably smaller than the other components of the press. In this respect, the weight Wr may be ignored in calculating the initial pneumatic pressure Po, that is, in adjusting the pneumatic pressure Pa.

The display section 84 of the operator's control panel 64 further has digital switches 94, 96, 98, 100 disposed below the indicators 86, 88, 90 and 92, respectively. These digital switches 94, 96, 98, 100 permit the operator to change the indicated values of the optimum blank-holding force Fso, weight Wr, number n and operating stroke L, as needed. If an ID CARD WRITE pushbutton 102 is depressed with the ID CARD COMM. selector switch 80 placed in the ON position, the values Fso, Wr, n and L stored in the ID card 72 and indicated on the indicators 86, 88, 90, 92 are replaced by the values set on the digital switches. Where the press in question is used as a trial press for testing a new die set, the appropriate values Fso, Wr, n and L are set on those digital switches 94, 96, 98, 100, and the pushbutton 102 is operated with the selector switch 80 turned ON, whereby the data Fso, Wr, n and L are stored in the ID card 72 (more precisely, die-set memory 74).

It will be understood from the foregoing description of the present embodiment that the cushioning device 42 is provided with a pneumatic pressure adjusting apparatus adapted to: calculate the optimum initial pneumatic pressure Po of the pneumatic pressure Pa according to the above equation (4) formulated so that the optimum initial pneumatic pressure Po as measured when the cushion platen 26 is at its lowermost or setup position provides the optimum blank-holding force Fso during a pressing operation; and adjust the pneumatic pressure Pa to the calculated optimum initial value Po when the cushion platen 26 is located at its lowermost or setup position, which is lower than the lower stroke end of the cushion platen 26 during a pressing cycle. Thus, the present arrangement eliminates the re-adjustment to raise the pneumatic pressure Pa after the cushion platen 26 is moved up to the upper stroke end for commencing a pressing job. Consequently, the non-productive time prior to the commencement of the pressing job is shortened, and the production efficiency of the press is accordingly increased. Further, since the calculation of the optimum initial pneumatic pressure Po and the adjustment of the pneumatic pressure Pa to the calculated optimum initial value Po are effected automatically by the control unit 62, the operator's workload in setting up the press is reduced, and the possibility of inadequate adjustment of the pneumatic pressure Pa due to erroneous manipulation of the press by the operator is minimized.

In the present embodiment, step S2 of the routine of FIG. 8 is a step of calculating the optimum initial pneumatic pressure Po, while step S3 is a step of adjusting the pneumatic pressure Pa to the calculated optimum initial value Po. The transceiver 70 and the ID card 72 provide input means for entering the die-set information, while the machine data memory 66 of the control unit 62 provides memory means for storing the machine information. Further, the portion of the control unit 62 assigned to implement step S2 constitutes means for calculating the optimum initial pneumatic pressure Po, and the portion of the control unit 62 assigned to implement step S3 cooperates with the shut-off valve 37, pneumatic pressure control circuit 38 and pneumatic pressure sensor 39 to constitute means for adjusting the pneumatic pressure Pa.

While the present invention has been described above in detail in its presently preferred embodiment by reference to the accompanying drawings, it is to be understood that the present invention may be otherwise embodied.

In the illustrated embodiment, the optimum initial value Po of the pneumatic pressure Pa is calculated so as to provide the optimum blank-holding force Fso when the press slide 20 or cushion platen 26 is located at its lower stroke end. However, the optimum initial pneumatic pressure Po may be calculated so as to provide the optimum blank-holding force Fso when the cushion platen 26 is located at a point slightly below the upper stroke end, that is, the optimum blank-holding force Fso immediately after the upper die 18 comes into abutting contact with the blank 40 (punch 10). In this case, the pneumatic pressure P1 when the cushion platen 26 is at the point slightly below its upper stroke end is obtained as the pneumatic pressure Pax calculated according to the above equation (1). This modified arrangement eliminates the use of the operating stroke L of the cushion platen 26. Further, since the optimum initial pneumatic pressure Po is calculated according to the following equation (5), the present arrangement may also eliminate the use of the above-indicated information such as the volume Va, initial axial dimension Xo and upper end axial dimension X1, if a volume ratio (V1/Vo) is stored as the machine information.

$$Po=Pax\cdot(V1/Vo) \quad (5)$$

The volume ration (V1/Vo) may be easily obtained according to an equation V1/Vo=Po/P1.

While the illustrated embodiment is adapted to automatically adjust the pneumatic pressure Pa under the control of the control unit 62, the pneumatic pressure Pa may be adjusted by the operator, using the operator's control panel 64. In this case, the control panel 64 further provides an indicator for indicating the optimum initial pneumatic pressure Po calculated in step S2, an indicator for indicating the actual pneumatic pressure Pa detected by the pneumatic pressure sensor 39, and switches for operating the shut-off valve 37 and pneumatic pressure control circuit 38. Further, the calculation of the optimum initial pneumatic pressure value Po may be calculated by the operator.

In the illustrated embodiment, the die-set information is stored in the ID card 72 and sent to the control unit 62 through the transceiver 70. However, the die-set information may be stored in other suitable memory means such as a medium which bears bar codes, a magnetic tape or a floppy disk. In this case, a suitable device connected to the control unit 62 reads the bar codes representative of the die-set information, or retrieves the die-set information from the magnetic tape, floppy disk or other storage medium. The die-set information may be entered by the operator through the operator's control panel 64.

Although the cushioning device 42 includes the multiple balancing hydraulic cylinders 30 through which the pressure ring 28 is supported, these hydraulic cylinders 30 are not essential. Namely, the cushion pins 22 which support the pressure ring 28 at their upper ends may abut directly on the cushion platen 26 at their lower ends.

It is to be understood that the present invention may be embodied with various other changes, modifications and improvements, which may occur to those skilled in the art, in the light of the foregoing teachings.

What is claimed is:

1. A method of setting up a press upon installation of a die set which includes a lower die, an upper die movable relative to said lower die to perform a pressing operation on a blank, and a pressure ring which cooperates with said upper die to hold said blank therebetween with a blank-holding force during said pressing operation, and adjusting pneumatic pressure in a cushioning pneumatic cylinder of a cushioning device so as to adjust said blank-holding force to a predetermined optimum value, said cushioning device including a cushion platen supporting said pressure ring and providing said blank-holding force based on said pneumatic pressure in said pneumatic cylinder, such that said blank-holding force is applied to said blank through said cushion platen and said pressure ring while said cushion platen is moved between an upper end of a stroke and a lower end of a stroke during said pressing operation, said method comprising the steps of:

moving said cushion platen to a setup position thereof lower than said lower end of the stroke;

installing said die set on said press;

calculating an optimum initial value of said pneumatic pressure as measured when said cushion platen is placed at said setup position, on the basis of die-set information relating to said die set and including said predetermined optimum value of said blank-holding force, and machine information relating to said cushioning device, said optimum initial value providing said predetermined optimum value of said blank-holding force during said pressing operation, irrespective of an increase in a volume of said pneumatic cylinder due to a movement of said cushion platen from said setup position to an operating position for the pressing operation; and adjusting said pneumatic pressure to the calculated optimum initial value when said cushion platen is located at said setup position.

2. A method according to claim 1, further comprising:

receiving said die-set information from an external device; and reading said machine information stored in machine data memory means.

3. A method according to claim 1, wherein said die-set information further includes a weight of said pressure member, while said machine information includes a weight of said cushion platen and a pressure-receiving area of said cushioning pneumatic cylinder.

4. A method according to claim 3, wherein said die-set information further includes an operating stroke of said cushion platen which takes place during said pressing operation on said blank, while said machine information further includes an axial dimension of an air chamber of said pneumatic cylinder when said cushion platen is located at said setup position, an axial dimension of said air chamber when said cushion platen is located at said upper stroke end, and a volume of an air tank communicating with said air chamber of said pneumatic cylinder.

5. A method according to claim 4, wherein said machine information includes a weight of each of a plurality of cushion pins disposed between said pressure member and said cushion platen for transmitting said blank-holding force from said cushion platen to said pressure member, and said die-set information further includes the number of said cushion pins.

6. A method according to claim 5, wherein said step of calculating an optimum initial value of said pneumatic pressure according to the following equation:

$$Po=(Fso+Wa+Wr+n\cdot Wp)/A\cdot\{Va+A\cdot(X1-L)\}/(Va+A\cdot Xo)$$

where,

Po=said optimum initial value of said pneumatic pressure,

Fso=said predetermined optimum value of said blank-holding force,

Wa=said weight of said cushion platen,

Wr=said weight of said pressure member, n=said number of said cushion pins,

Wp=said weight of said each cushion pin,

A=said pressure-receiving area of said pneumatic cylinder,

Va=said volume of said air tank,

X1=said axial dimension of said air chamber when said cushion platen is located at said upper stroke end, Xo=said axial dimension of said air chamber when said cushion platen is located at said setup position, L=said operating stroke of said cushion platen.

7. A method according to claim 1, wherein said step of moving said cushion platen to said setup position comprises draining said pneumatic cylinder before pneumatic pressure is adjusted to said calculated optimum initial value.

8. A method according to claim 1, wherein said operating position of said cushion platen is said lower end of the stroke of said cushion platen.

9. A method according to claim 1, wherein said operating position of said cushion platen is said upper end of the stroke of said cushion platen.

10. An apparatus for adjusting a pneumatic pressure in a cushioning pneumatic cylinder of a cushioning device of a press upon installation of a die set which includes a lower die, an upper die movable relative to said lower die to perform a pressing operation on a blank, and a pressure ring which cooperates with said upper die to hold said blank therebetween with a blank-holding force during said pressing operation, said cushioning device including a cushion platen supporting said pressure ring and providing said blank-holding force based on said pneumatic pressure in said pneumatic cylinder, such that said blank-holding force is applied to said blank through said cushion platen and said pressure ring while said cushion platen is moved between an end of an upper stroke and an end of a lower stroke during said pressing operation, said apparatus comprising:

input means for entering die-set information relating to said die set and including a predetermined optimum value of said blank-holding force to be applied to said blank during said pressing operation;

machine data memory means for storing machine information relating to said cushioning device;

positioning means for holding said cushion platen to a setup position thereof lower than said end of the lower stroke;

calculating means for calculating an optimum initial value of said pneumatic pressure as measured when said cushion platen is placed at said setup position, on the basis of said die-set information and said machine information, said optimum initial value of said pneumatic pressure providing said predetermined optimum value of said blank-holding force during said pressing operation, irrespective of an increase in a volume of said pneumatic cylinder due to a movement of said cushion platen from said setup position to an operating position for the pressing operation; and adjusting means for adjusting said pneumatic pressure to the calculated optimum initial value when said cushion platen is located as said setup position.

11. An apparatus according to claim 10, wherein said input means includes a memory card attached to said die set.

12. An apparatus according to claim 11, wherein said memory card includes a die-set memory for storing said die-set information, and a first transceiver, and wherein said input means further includes a second transceiver for receiving said die-set information from said die-set memory through said first transceiver.

13. An apparatus according to claim 12, further comprising an operator's control panel which has operator-controlled means for changing said die-set information stored in said die-set memory.

14. An apparatus according to claim 10, wherein said calculating means includes a microcomputer which comprises a read-only memory storing an equation which is formulated to obtain said optimum initial value of said pneumatic pressure on the basis of said die-set information and said machine information so that said optimum initial value of said pneumatic pressure established when said cushion platen is located at said setup position provides said predetermined optimum value of said blank-holding force when said cushion platen is located at said operating position during said pressing operation.

15. An apparatus according to claim 10, wherein said adjusting means comprises a control unit, pressure control means controlled by said control unit for controlling said pneumatic pressure of said pneumatic cylinder, and a pressure sensor for detecting said pneumatic pressure.

* * * * *